US005730511A

United States Patent [19]

Doan et al.

[11] Patent Number: 5,730,511

[45] Date of Patent: Mar. 24, 1998

[54] ONE-PIECE DRAWER FRONT

[75] Inventors: Jimmy T. Doan, Kenosha, Wis.; Chak Chung Chan (Jason), Richmond Hill, Canada

[73] Assignee: Snap-on Technologies, Inc., Lincolnshire, Ill.

[21] Appl. No.: 516,865

[22] Filed: Aug. 18, 1995

[51] Int. Cl.[6] ..... A47B 81/00

[52] U.S. Cl. ..... 312/234.4; 312/348.4

[58] Field of Search ..... 312/348.4, 332.1, 312/234.3, 234.4, 234.2, 234.1

[56] References Cited

U.S. PATENT DOCUMENTS

| | | | |
|---|---|---|---|
| Re. 28,280 | 12/1974 | Aleks . | |
| 1,453,121 | 11/1923 | Benner . | |
| 1,876,748 | 9/1932 | Rand, Jr. et al. . | |
| 1,897,080 | 2/1933 | Soper . | |
| 1,934,397 | 11/1933 | Bales et al. . | |
| 2,689,777 | 9/1954 | Wolters . | |
| 3,031,248 | 4/1962 | Jeeves . | |
| 3,245,744 | 4/1966 | Olson . | |
| 3,252,746 | 5/1966 | Kafferlin et al. . | |
| 3,450,453 | 6/1969 | Tazaki . | |
| 3,469,875 | 9/1969 | Ahlgren . | |
| 4,320,834 | 3/1982 | Tamaki . | |
| 4,553,353 | 11/1985 | Simpson . | |
| 4,653,820 | 3/1987 | Tazaki . | |
| 4,790,579 | 12/1988 | Maxwell et al. . | |
| 5,292,191 | 3/1994 | Slivon | 312/332.1 |
| 5,388,902 | 2/1995 | Huebschen et al. . | |
| 5,403,139 | 4/1995 | Slivon et al. . | |

FOREIGN PATENT DOCUMENTS

| | | |
|---|---|---|
| 511918 | 11/1992 | European Pat. Off. . |
| 204469 | of 0000 | Taiwan . |
| 214062 | of 0000 | Taiwan . |

OTHER PUBLICATIONS

Lista International Corporation, Catalog MP–91 –MP Cabinets and Workbench Systems, cover page and pp. 4, 5, and 15.

*Primary Examiner*—Peter M. Cuomo
*Assistant Examiner*—Gerald A. Anderson
*Attorney, Agent, or Firm*—Emrich & Dithmar

[57] ABSTRACT

A one-piece front for a drawer is provided. The front includes a generally planar front wall having a top end and a bottom end, and an elongated drawer pull integral with the top end of the front wall. The pull includes an identifier support for displaying and supporting an associated identification card.

16 Claims, 1 Drawing Sheet

ONE-PIECE DRAWER FRONT

BACKGROUND OF THE INVENTION

1. Field of the Invention

This invention relates to drawers and, in particular to drawer fronts with identification means.

2. Description of the Prior Art

Most drawer fronts have a multi-piece construction. These fronts typically have a drawer pull or handle member, a front wall member, a member to house a locking mechanism and a member to house an identification card. These multi-piece drawer fronts are costly, since they require several individual pieces and time and labor to manufacture and assemble the individual pieces.

Single-piece drawer fronts have also been utilized but typically do not include means to house either a locking mechanism or identification cards.

SUMMARY OF THE INVENTION

It is a general object of the invention to provide an improved drawer front which avoids the disadvantage of prior drawer fronts while affording additional structural and operational advantages.

An important feature is the provision of a drawer front which is of relatively simple and economical construction.

A still further feature of the invention is to provide a one-piece drawer front that can house both an identification card and a member of a drawer locking mechanism.

These and other features of the invention are attained by providing a one-piece front for a drawer comprising a generally planar front wall having a top end and a bottom end, an elongated drawer pull integral with the top end of the front wall, the pull includes an identifier support for displaying and supporting an associated identification card.

The invention consists of certain novel features and a combination of parts hereinafter fully described, illustrated in the accompanying drawings, and particularly pointed out in the appended claims, it being Understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENTS

Figure 1:
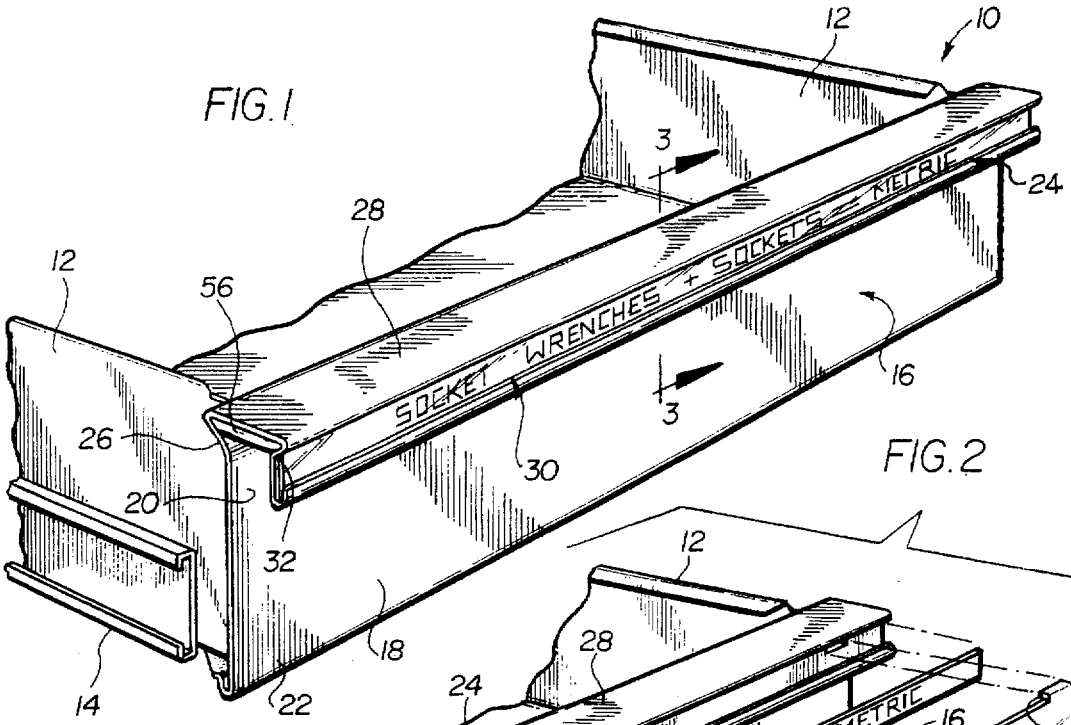
FIG. 1 is a fragmentary perspective view of drawer with the drawer front of the present invention.

Referring to FIG. 1, a drawer 10, such as a drawer for a tool box, is provided. The drawer 10 has a pair of sidewalls

12 each having a slide member 14 of a slide assembly connected thereto. The slide assembly allows the drawer to be slid into and out of a cabinet or other drawer housings.

The drawer 10 also includes a drawer front 16 connected to both of the sidewalls 12. The drawer front 16 is a one-piece member and includes a substantially planar front wall 18 having a top end 20 and a bottom end 22. The drawer front 16 has an elongated drawer pull 24 integral with the top end 20 of the front wall 18. Pull 24 includes a rear flange 26 integral with the top end 20 and bent rearwardly from the planar front wall 18. Pull 24 also includes a top flange 28 integral with the rear flange 26 and substantially perpendicular to the front wall 18. The pull 24 also includes a front flange 30 integral with and depending from the top flange 28.

Figure 2:
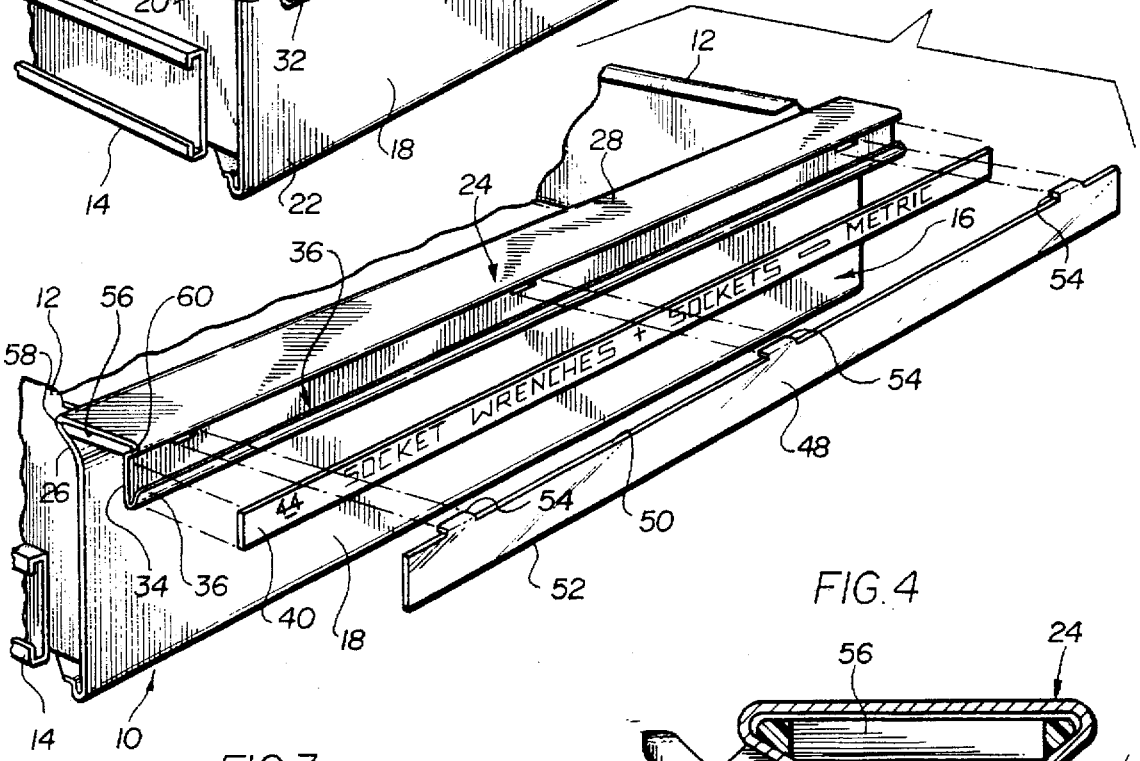
FIG. 2 is a view similar to FIG. 1 with the drawer front exploded.
Figure 3:
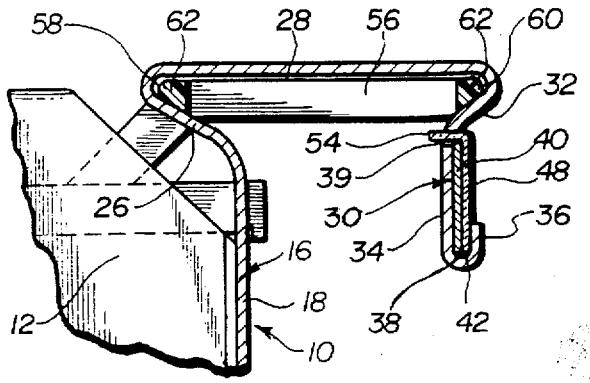
FIG. 3 is an enlarged sectional view taken along the line 3—3 of FIG. 1.

As best seen in FIGS. 2 and 3, the front flange 30 includes a top portion 32, a generally planar central portion 34, and a bottom portion 36. The top portion 32 is bent rearwardly from the top flange 28 toward the rear flange 26 and is integral with the generally planar central portion 34. The bottom portion 36 is bent upwardly and forwardly from and integral with central portion 34 to form a channel 38 therebetween. As discussed below, the central portion 34 also has three equidistantly-spaced and generally rectangular-shaped apertures 39 therein located at the upper end thereof.

As seen in FIGS. 1–3, a generally rectangular identification card 40 has a lower edge disposed within the channel 38. The identification card 40 can be used to label the contents of the drawer 10 and can be constructed of almost any material that can somehow be labelled, such as by writing, printing or etching. Such materials includes cardboard, paper and metal. The identification card 40 has a length that is slightly less than the length of the pull 24, a width less than the distance between the bottom of the apertures 39 and a bottom 42 of the channel 38 and a thickness less than the maximum front-to-back depth of the channel 38, as measured by the maximum distance between the central portion 34 and the bottom portion 36. The identification card 40 has a front indicia-bearing face 44 for labelling and for viewing by a user and a rear face 46 which abuts the central portion 34.

As best seen in FIGS. 2 and 3, a generally rectangular transparent sheet 48 is disposed in channel 38 between the identification card 40 and the bottom portion 36. The transparent sheet 48 has a top end 50 and bottom end 52. Three equidistantly-spaced and generally rectangular-shaped locking tabs 54 project from the top end 50.

The tabs 54, are respectively disposed through and cooperate with the apertures 39 to lock the transparent sheet 48 to the pull 24. The transparent sheet 48 both aids in preventing the identification card 40 from being displaced from the pull 24 and protects the identification card 24 from damage from the elements that may deteriorate the identification card 40 and/or render the labelling on the card 40 unreadable. The transparent sheet 48, including the tabs 54, can be a flexible planar plastic sheet that allows the tabs 54 to be bent into the apertures 39 or a plastic sheet with pre-bent tabs.

As seen best in FIG. 3, the pull 24, can slideably support a slideable latch bar 56 of a latch mechanism which cooperates with a hole in a sidewall of a cabinet or drawer housing (not shown) to maintain the drawer 10 in a closed position. The pull 24 can support latch bars of latch mechanisms such as those described in commonly assigned U.S. Pat. Nos. 5,403,139 and 5,388,902, the disclosures of which are incorporated herein by reference.

As seen in FIG. 3, top flange 28 and rear flange 26 define a first channel 58 under the top flange 28 that substantially runs the length of the pull 24. Similarly, the top flange 28 and the top portion 32 of the front flange 30 define a second channel 60 facing the first channel 58 and located under the top flange 28. The channel 60 also runs substantially the length of the pull 24. Latch bar 56 has a pair of front and rear longitudinal ends 62 which are, respectively, disposed in the first and second channels 58, 60 and supported on the rear flange 26 and the top portion 32 of the front flange 30. Latch bar 56 is slideable within the channels 38, 40 along the length of the pull 24.

Figure 4:
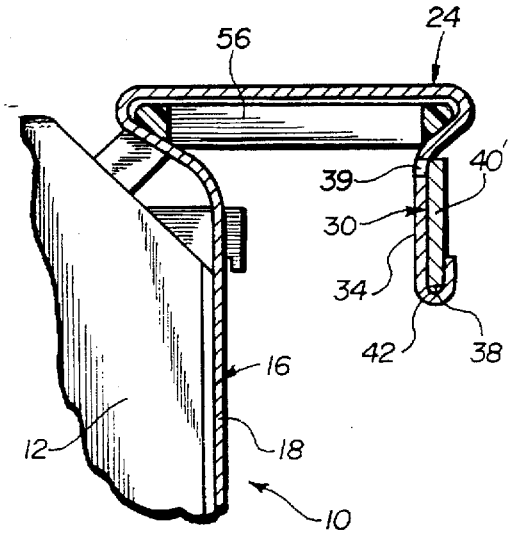
FIG. 4 is a sectional view similar to FIG. 3 illustrating an alternative drawer identification means.

As seen in FIG. 4, if the drawer front 18 is made of a metal, an alternative identification card 40' can be disposed in channel 38. Identification card 40' is comprised of a magnetic material, such as a magnetic tape, which magnetically adheres to the central portion 34 of the front flange 30. Since there is a magnetic adherence between the identification card 40' and the central portion 34, no transparent sheet is necessary to lock the identification card 40' to the pull 24. This allows the identification card 40' to have a larger height and width than the identification card 40 of FIGS. 1–3. Additionally, if only magnetic material identification cards are to be used, the pull 24 can be manufactured without the apertures 39.

Though there is no transparent sheet 48 to prevent the dislodgement of the identification card 40' from the pull 24, the magnetic adherence of the identification card 40' along with the retaining action of the bottom portion 36 of the front flange 30 and the channel 38 cooperate to prevent the dislodgement of the identification card 40' from the pull 24 when a user's fingers come in contact with the identification card 40' when opening or closing the drawer 10.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A front for a drawer comprising:

a generally planar front wall having a top end and a bottom end; and an elongated drawer pull integral with the top end of the front wall, the pull including a rear flange integral with the top end of the front wall, a top flange having rear and front ends, wherein the rear end is integral with the rear flange, and a front flange having a first portion integral with the front end of the top flange and cooperating therewith to form a first channel, the front flange further including a generally planar second portion integral with the first portion and substantially parallel to the front wall and a third portion integral with the second portion and cooperating therewith to define a support channel adapted to receive an edge of an associated identification card.

2. The front of claim 1, wherein the identifier support includes a channel for supporting the associated identification card.

3. The front of claim 1, wherein the pull further includes an identifier support for supporting and displaying an associated identification card.

4. The front of claim 1, wherein the rear flange is offset from the plane of the front wall, and the rear end of the top flange cooperates with the rear flange to define a second channel facing the first channel.

5. The front of claim 1, wherein the front has a length and the pull has a length substantially equal to the length of the front.

6. A front for a drawer comprising:

an identification card for identifying the contents of the drawer; and a one-piece member, the member comprising:

a generally planar front wall having a top end and a bottom end;

an elongated drawer pull integral with the top end of the front wall, the pull including a rear flange integral with the top end of the front wall, a top flange having rear and front ends, wherein the rear end is integral with the rear flange, and a front flange having a first portion integral with the front end of the top flange and cooperating therewith to form a first channel, wherein the identifier support includes a generally planar second portion of the front flange integral with the first portion of the front flange and substantially parallel to the front wall and a third portion of the front flange integral with the second portion and cooperating therewith to define a support channel for supporting the identification card, and wherein the identification card is disposed adjacent the second portion and at least a first portion of the identification card is disposed in the support channel for supporting the identification card and a second portion of the identification card is disposed above the support channel to allow a viewer to view the second portion of the identification card.

7. The front of claim 6, wherein the identifier support includes a channel for supporting the identification card.

8. The front of claim 7, wherein the rear flange is offset from the plane of the front wall, and the rear end of the top flange cooperates with the rear flange to define a second channel facing the first channel.

9. The front of claim 7 wherein the front has a length and the pull has a length substantially equal to the length of the front.

10. The front of claim 7, and further comprising a card maintainer for maintaining the identification card on the identifier support.

11. The front of claim 10, wherein the card maintainer includes a plurality of locking apertures disposed in the front flange and a substantially planar transparent sheet having a bottom end disposed within the third channel and a top end having a plurality of locking tabs, wherein the identification card is disposed between the second portion of the front flange and the transparent sheet and each locking tab cooperates with an aperture to connect the transparent sheet to the front flange to maintain the identification card on the identifier support.

12. The front of claim 11, wherein the apertures are disposed in the planar second portion of the front flange.

13. The front of claim 11, wherein the identification means is comprised of a non-metallic material.

14. The front of claim 7, wherein the identification card is comprised of a magnetic material and the front is comprised of a metal wherein the identification card is magnetically adhered to the second portion of the front.

15. A one-piece front for a drawer comprising:

a generally planar front wall having a top end and a bottom end; and an elongated drawer pull integral with the top end of the front wall, the pull including a rear flange integral with the top end of the front wall and offset from the plane of the front wall;

a top flange having rear and front ends, wherein the rear end is integral with the rear flange and cooperates therewith to define a first channel therebetween; and a front flange having a first portion integral with the front end of the top flange and cooperating therewith to define a second channel facing the first channel, wherein the front flange includes a generally planar second portion integral with the first portion and substantially parallel to the front wall and a third portion integral with the second portion and cooperating therewith to define a third channel adapted to receive an edge of an associated identification card.

16. The front of claim 15, wherein the pull further includes an identifier support for supporting and displaying an associated identification card.

* * * * *

UNITED STATES PATENT AND TRADEMARK OFFICE

CERTIFICATE OF CORRECTION

PATENT NO. : 5,730,511
DATED : March 24, 1998
INVENTOR(S) : Jimmy T. Doan et al.

It is certified that error appears in the above-identified patent and that said Letters Patent is hereby corrected as shown below:

Column 3,
Lines 62 to 64, delete claim 2.

Column 4,
Lines 35 to 36, delete claim 7.
Line 37, "7" should be -- 6 --.
Line 41, "7" should be -- 6 --.
Line 61, "7" should be -- 9 --.

Signed and Sealed this

Eighteenth Day of September, 2001

*Attest:*

Nicholas P. Godici

*Attesting Officer*

NICHOLAS P. GODICI
*Acting Director of the United States Patent and Trademark Office*